US006071164A

United States Patent [19]

Vollmer

[11] Patent Number: 6,071,164

[45] Date of Patent: Jun. 6, 2000

[54] METHOD FOR PRODUCING A HIGH-PRESSURE DISCHARGE LAMP

[75] Inventor: Lothar Vollmer, Berlin, Germany

[73] Assignee: Patent-Truehand-Gesellschaft fuer Electrische Gluelampen mbH, Munich, Germany

[21] Appl. No.: 09/171,412

[22] PCT Filed: Oct. 1, 1997

[86] PCT No.: PCT/DE97/02255

§ 371 Date: Oct. 19, 1998

§ 102(e) Date: Oct. 19, 1998

[87] PCT Pub. No.: WO98/38668

PCT Pub. Date: Sep. 3, 1998

[30] Foreign Application Priority Data

Feb. 26, 1997 [DE] Germany ..... 197 07 669

[51] Int. Cl.[7] ..... H01J 9/32

[52] U.S. Cl. ..... 445/26

[58] Field of Search ..... 445/26, 43

[56] References Cited

U.S. PATENT DOCUMENTS 5,252,888 10/1993 Topel et al. .

5,432,399 7/1995 Nagasawa et al. .

5,772,487 6/1998 Lee ..... 445/26

FOREIGN PATENT DOCUMENTS 0696046 2/1996 European Pat. Off. .

9428576 12/1994 WIPO .

*Primary Examiner*—Kenneth J. Ramsey

*Attorney, Agent, or Firm*—William H. McNeill

[57] ABSTRACT

The invention relates to a method for producing a high-pressure discharge lamp, there being provided in the course of the production method a prefabricated discharge vessel (1) in which there is an enclosed ionizable filling, and in which electrodes (E1, E2) are arranged, and which has at least one sealed end (1*b*) and at least one supply lead (3*b*) projecting from said sealed end (1*b*), the at least one sealed end (1*b*) of the discharge vessel (1) having a tubular extension (1*c*) in which the at least one supply lead (3*b*) runs. According to the invention, the production method has the fabrication steps of filling glass shot (6) into the tubular extension (1*c*), so that the interspace between the at least one supply lead (3*b*) and the tubular extension (1*c*) is filled up with glass shot (6), and sealing the tubular extension (1*c*) by supplying heat.

11 Claims, 2 Drawing Sheets

METHOD FOR PRODUCING A HIGH-PRESSURE DISCHARGE LAMP

Figure 1:
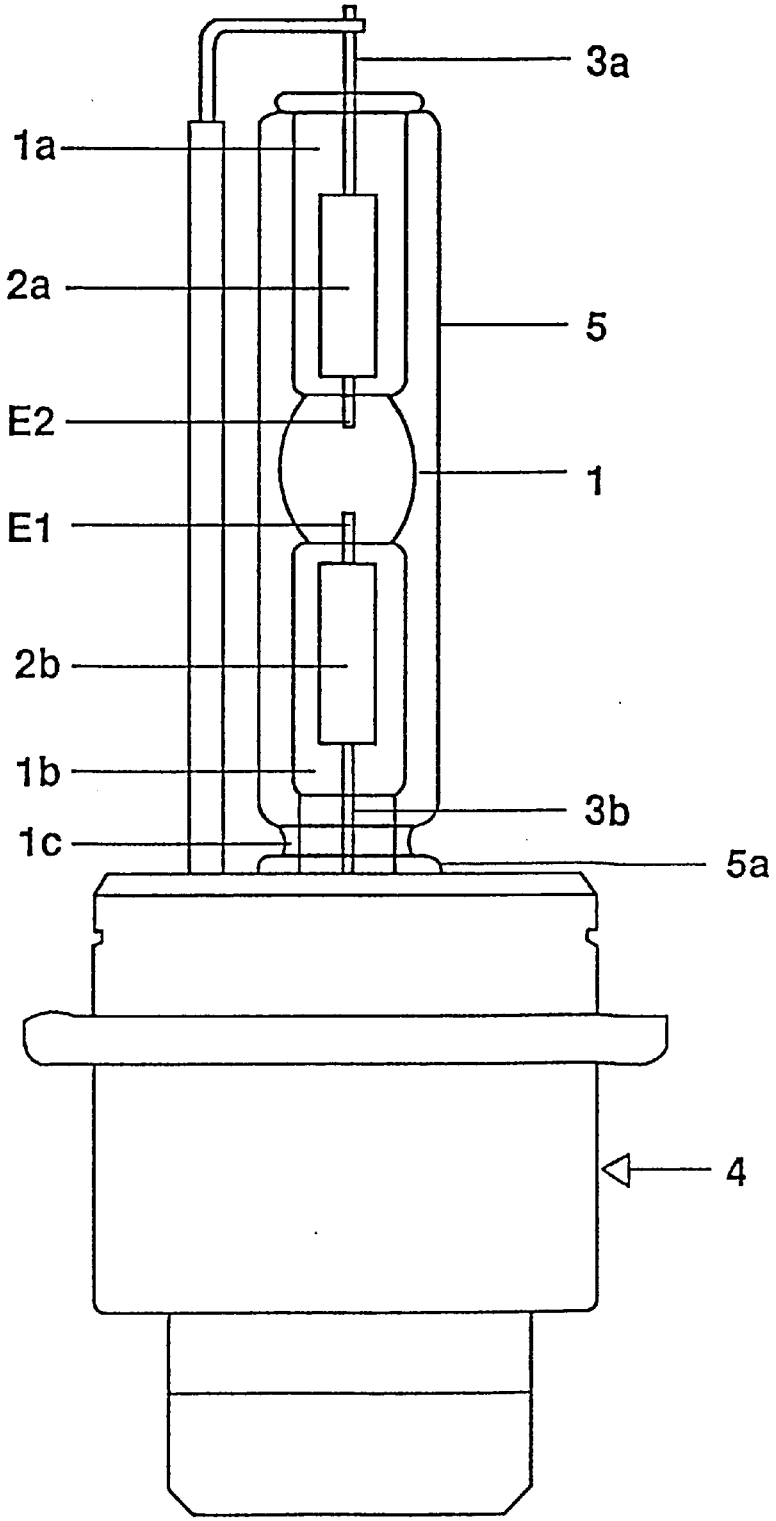

The invention relates to a method for producing a high-pressure discharge lamp in accordance with the preamble of patent claim 1.

PRIOR ART

Such a production method is disclosed, for example, in the international patent application PCT/DE94/00600. Said patent application describes a high-pressure discharge lamp with a base at one end, and a production method for a high-pressure discharge lamp with a base at one end, which has a discharge vessel which is sealed at two ends and in which there is an enclosed ionizable filling, and in which two electrodes are arranged, the end of the discharge vessel on the base side having a tubular extension in which the base-side supply lead runs. This base-side supply lead is sealed in a gastight fashion in the base-side end of the discharge vessel. It connects the base-side lamp electrode to the corresponding base contact. The interspace between the base-side supply lead and the inner wall of the tubular extension is empty here, that is to say filled with air. Normally, the high-pressure discharge lamp is fed the starting voltage required to start it via the base-side supply lead for reasons of safety, while the current return path, which is remote from the base and connected to the electrode, which is remote from the base, is at frame potential. It has emerged that the electric insulation of the base-side supply lead running in the tubular extension of the base-side end of the discharge vessel is not sufficient in every case.

SUMMARY OF THE INVENTION

It is the object of the invention to provide a method for producing a high-pressure discharge lamp having an improved electric insulation of the supply leads projecting from the discharge vessel and running in the tubular extension of the end of the discharge vessel.

This object is achieved according to the invention by means of the characterizing features of patent claim 1. Particularly advantageous designs of the invention are described in the subclaims.

In the course of the production method according to the invention, a prefabricated discharge vessel is provided in which there is an enclosed ionizable filling and in which electrodes are arranged, and which has at least one sealed end and at least one supply lead projecting from said sealed end, the at least one sealed end of the discharge vessel having a tubular extension which is open at one end and in which the at least one supply lead runs. According to the invention, the production method according to the invention includes the two following additional fabrication steps:

filling glass shot into the tubular extension, so that the interspace between the at least one supply lead and the tubular extension is filled up with glass shot, and sealing the tubular extension by supplying heat.

The electric insulation of the at least one supply lead running in the tubular extension is improved by means of these measures according to the invention. In order to ensure that the tubular extension is filled up uniformly with glass shot, the glass shot is advantageously compacted by means of a vibrator after being filled into the tubular extension and before the tubular extension is sealed. The glass shot advantageously comprises glass beads or glass particles whose diameter or particle size is not more than 0.3 mm and, in particular, is advantageously between 0.03 mm and 0.15 mm. It is possible as a result for the interspace between the at least one supply lead running in the tubular extension and the inner wall of the tubular extension to be filled up optimally. It is advantageous to use as glass shot material soft glass or hard glass which has a sufficient heat resistance and is an excellent electric insulator. By contrast with soft glass, the use of hard glass has the advantage that the coefficient of thermal expansion of the hard glass is closer to the coefficient of thermal expansion of the silica glass of the tubular extension of the discharge vessel than that of the soft glass, with the result that there is less of a tendency for cracks or flaws to form in the tubular extension. The glass particles are advantageously heated at the surface of the glass shot filling in order to seal the tubular extension. As a result, the glass particles situated at the surface of the glass shot filling are sintered with one another or fused with one another and with the inner wall of the tubular extension. The mutually sintered or fused glass particles form a stopper which seals the tubular extension and prevents loss of the non-sintered glass shot filling.

By contrast with fusing, the term sintering signifies that the glass particles of the glass shot filling are heated to the extent that they soften and in the process are bonded to one another without losing their shape by being heated. The sintering of the glass particles thus occurs already at a lower temperature, specifically at the softening temperature of the glass particles, than does the fusing of the glass particles. The sintering of the glass particles therefore requires a lower outlay on energy than the fusing of the glass particles, and is therefore preferably applied.

DESCRIPTION OF THE PREFERRED EXEMPLARY EMBODIMENT

Figure 2:
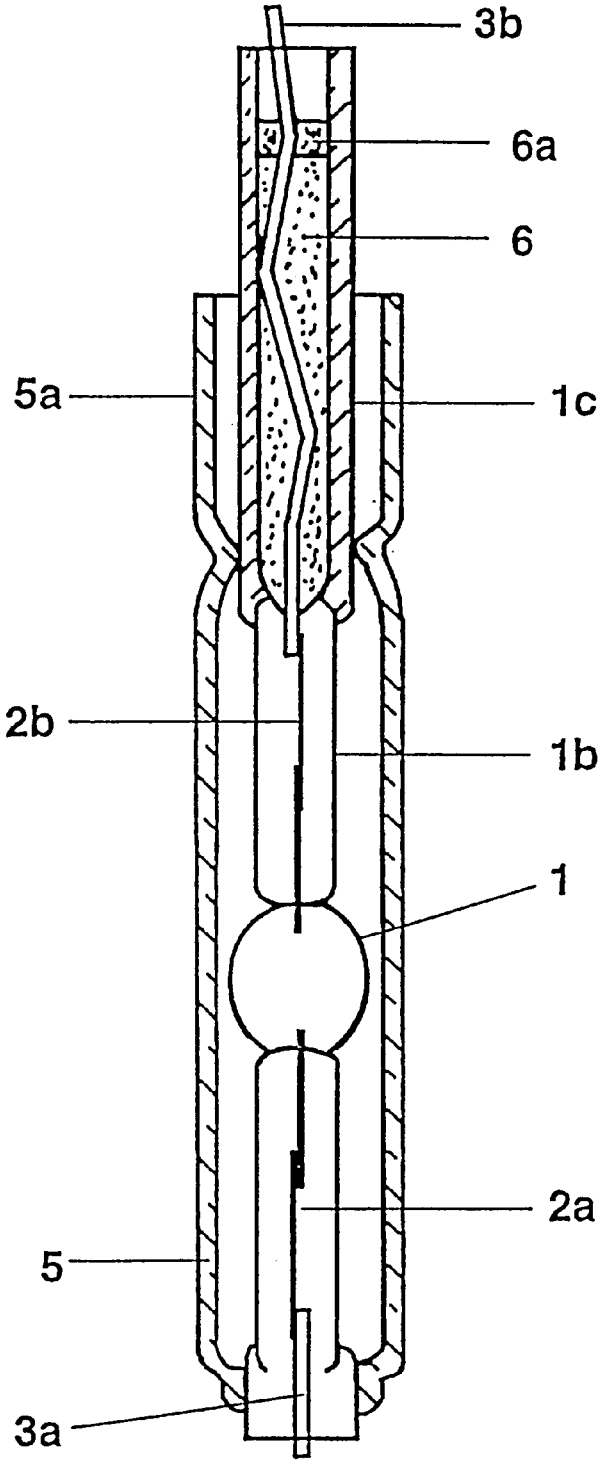

The invention is explained in more detail below with the aid of a preferred exemplary embodiment. In the drawing:

FIG. 1 shows a diagrammatic side view of a high-pressure discharge lamp fabricated using the method according to the invention, and FIG. 2 shows the discharge vessel of the high-pressure discharge lamp of FIG. 1, as fabricated using the method according to the invention.

The high-pressure discharge lamp illustrated in FIGS. 1 and 2 and produced using the method according to the invention is a high-pressure discharge lamp with a base at one end and intended for a motor vehicle headlight. The design of this high-pressure discharge lamp is represented diagrammatically in FIG. 1.

The lamp has a discharge vessel 1 sealed at both ends, which is made from silica glass and in which an ionizable filling is enclosed in a gastight fashion. The ionizable filling contains xenon and metal halide compounds. The two ends 1*a*, 1*b* of the discharge vessel 1 are sealed in each case by means of a molybdenum foil seal 2*a*, 2*b*. Located in the interior of the discharge vessel 1 are two electrodes E1, E2, between which the discharge arc responsible for the emission of light is formed during operation of the lamp. The electrodes E1, E2 are in each case connected in an electrically conducting fashion to the electric terminal of the lamp base 4 via one of the molybdenum foil seals 2*a*, 2*b* and via the supply lead 3*a* remote from the base or via the base-side current return path 3*b*. The discharge vessel 1 is enclosed by a vitreous outer bulb 5. The outer bulb 5 has an extension 5*a* anchored in the base 4. On the base side, the discharge vessel 1 has a tubular extension 1*c* made from silica glass, in which the base-side supply lead 3*b* runs. A detailed description of the design of this lamp is to be found, for example, in the laid-open specification EP 0 696 046.

This high-pressure discharge lamp is used below to explain the production method according to the invention by way of example.

In the course of the production method according to the invention, the first step is to fabricate and provide in a known way a basic unit comprising a discharge vessel 1, which is sealed at two ends by means of molybdenum foil seals 2*a*, 2*b* and provided at the base-side end 1*b* with a tubular extension 1*c*, and in which there is enclosed an ionizable filling and in which electrodes E1, E2 are arranged, and comprising an outer bulb 5 fastened to the discharge vessel 1. The production of this basic unit is described, for example, in the patent applications PCT/DE94/00600 or EP 0 696 046. Said basic unit also comprises the two supply leads 3*a*, 3*b* projecting from the ends 1*a*, 1*b* of the discharge vessel. The base-side supply lead 3*b* runs in this case in a zig zag inside the tubular extension 1*c*. Glass shot 6 is filled into the base-side tubular extension 1*c* of the discharge vessel 1 and fills up the interspace between the base-side supply lead 3*b* and the inner wall of the tubular extension 1*c*. The glass shot 6 comprises hard glass particles or hard glass beads of different size. The maximum particle size or the maximum diameter of the hard glass particles is 0.03 mm to 0.15 mm. In order to ensure that the tubular extension 1*c* is filled up uniformly with the glass shot 6, the glass shot 6 filled into the tubular extension 1*c* is compacted by means of a vibrator. The glass shot filling 6 extends from the sealed base-side end 1*b* of the discharge vessel 1 as far as approximately 2 mm to 5 mm below the open end of the tubular extension 1*c*. In order to seal the open end of the tubular extension 1*c*, the glass shot beads 6*a* situated at the surface of the glass shot filling 6, that is to say the glass shot particles 6*a* last filled in and defining the filling edge, are heated with the aid of a gas burner until they are sintered with one another and with the inner wall of the tubular extension 1*c*. For this purpose, the glass shot particles 6*a* are heated to a temperature of at least 750° C. At this temperature, the glass shot particles 6*a* soften, but without losing their shape and bond to one another. After cooling, the glass shot particles 6*a* thus treated are sintered among themselves and with the inner wall of the tubular extension 1*c*. The sintering zone 6*a* has a depth or length from approximately 2 mm up to 10 mm. The glass particles 6*a* sintered with one another form a stopper which seals the open end of the tubular extension 1*c* and prevents the non-sintered glass shot filling 6 from falling out. The basic unit comprising the discharge vessel 1 and the outer bulb 5 is provided with a base in a known way. This way is described, for example, in patent application EP 0 696 046.

The invention is not limited to the exemplary embodiment explained in more detail. Thus, for example, the entire glass shot filling 6 can also be heated and sintered with one another. It is, however, also possible to heat the glass particles 6*a* at the filling edge of the glass shot filling 6 until they fuse and crosslink with the inner wall of the tubular extension 1*c*, resulting in this way in a glass stopper which seals the tubular extension 1*c*. It is also possible, furthermore, to seal the open end of the tubular extension of the discharge vessel by means of a pinch seal after filling in the glass shot.

What is claimed is:

1. A method for producing a high-pressure discharge lamp, there being provided in the course of the production method a prefabricated discharge vessel (1) in which there is an enclosed ionizable filling, and in which electrodes (E1, E2) are arranged, and which has at least one sealed end (1*b*) and at least one supply lead (3*b*) projecting from said sealed end (1*b*), the at least one sealed end (1*b*) of the discharge vessel (1) having a tubular extension (1*c*) which is open at one end and in which the at least one supply lead (3*b*) runs, wherein the production method has the following fabrication steps:

filling glass shot (6) into the tubular extension (1*c*), so that the interspace between the at least one supply lead (3*b*) and the tubular extension (1*c*) is filled up with glass shot (6), and sealing the tubular extension (1*c*) by supplying heat.

2. The method for producing a high-pressure discharge lamp as claimed in claim 1, wherein the glass shot (6) is compacted by means of a vibrator after being filled into the tubular extension (1*c*) and before the tubular extension (1*c*) is sealed.

3. The method for producing a high-pressure discharge lamp as claimed in claim 1, wherein the glass shot (6) comprises glass beads or glass particles whose diameter or particle size is at most 0.3 mm.

4. The method for producing a high-pressure discharge lamp as claimed in claim 3, wherein the glass shot (6) comprises glass beads or glass particles whose diameter or particle size is between 0.03 mm and 0.15 mm.

5. The method for producing a high-pressure discharge lamp as claimed in claim 1, wherein the glass shot (6) comprises hard glass.

6. The method for producing a high-pressure discharge lamp as claimed in claim 1, wherein the glass shot (6) comprises soft glass.

7. The method for producing a high-pressure discharge lamp as claimed in claim 1, wherein the glass shot particles (6*a*) are heated at the surface of the glass shot filling (6) in order to seal the tubular extension.

8. The method for producing a high-pressure discharge lamp as claimed in claim 7, wherein at least the glass shot particles (6*a*) situated at the surface of the glass shot filling (6) and defining the filling edge are sintered with one another.

9. The method for producing a high-pressure discharge lamp as claimed in claim 8, wherein the glass shot particles (6*a*) situated in at least the surface of the glass shot filling are heated to a temperature of at least 750° C. so that the glass shot particles (6*a*) soften and bond to one another.

10. The method for producing a high-pressure discharge lamp as claimed in claim 8, wherein the zone of the glass shot particles (6*a*) sintered with one another has a depth of at least 2 mm.

11. A high-pressure discharge lamp produced using the method according to claim 1.

* * * * *